United States Patent [19]

Archer et al.

[11] 4,051,476

[45] Sept. 27, 1977

[54] PARABOLIC HORN ANTENNA WITH MICROSTRIP FEED

[75] Inventors: Donald H. Archer; Sherwood A. McOwen, Jr.; Robert J. Prickett, all of Santa Barbara, Calif.

[73] Assignee: Raytheon Company, Lexington, Mass.

[21] Appl. No.: 672,707

[22] Filed: Apr. 1, 1976

[51] Int. Cl.[2] ..... H01Q 13/02

[52] U.S. Cl. ..... 343/700 MS; 343/779; 343/783; 343/840

[58] Field of Search ..... 343/753, 754, 755, 783, 343/840, 700 MS, 779

[56] References Cited

U.S. PATENT DOCUMENTS

| | | | |
|---|---|---|---|
| 2,822,541 | 2/1958 | Sichak et al. | 343/783 |
| 3,964,069 | 6/1976 | McDonough | 343/754 |

*Primary Examiner*—Eli Lieberman

*Attorney, Agent, or Firm*—Richard M. Sharkansky; Joseph D. Pannone

[57] ABSTRACT

An antenna element is disclosed having a printed circuit parallel plate region with a parabolically shaped reflecting wall and a flared radiating section. The flared radiating section is disposed along an aperture which intersects the axis of the parabola at an acute angle. A microstrip feed formed integrally with the printed circuit parallel plate region is offset from the reflecting wall and is adapted to introduce radio frequency energy at the focal point of such reflecting wall. Load material is disposed adjacent to the focal point to absorb radio frequency energy reflected by the aperture thereby improving the VSWR of the feed. Such arrangement enables close element-to-element spacing in an array, thereby substantially eliminating grating lobes while enabling intermeshing of the elements to provide port and starboard array antennas.

8 Claims, 9 Drawing Figures

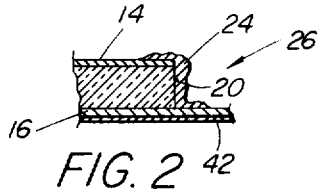
FIG. 2
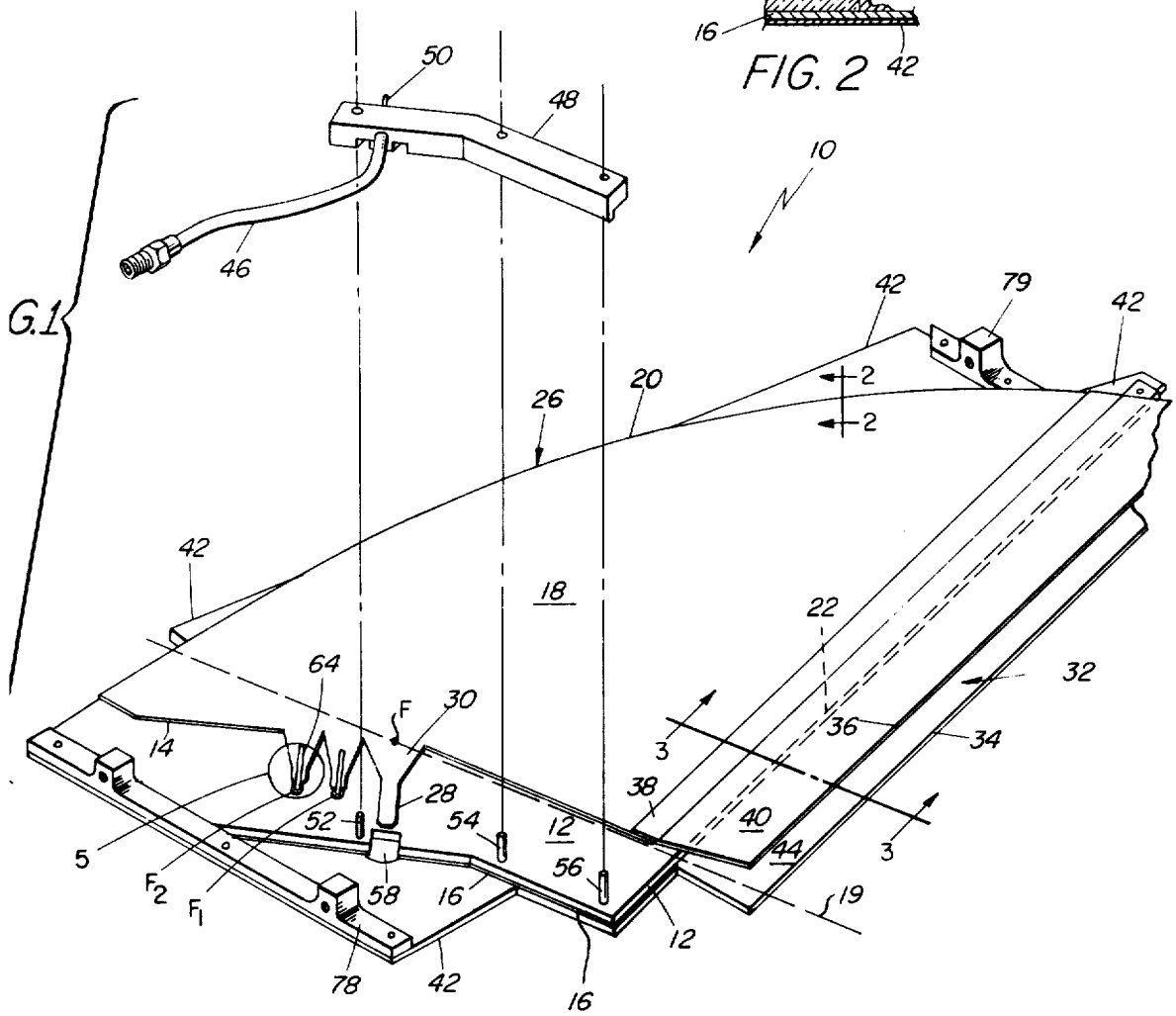
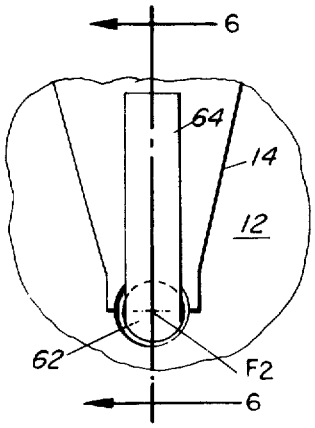
FIG. 5
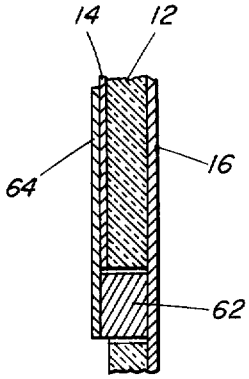
FIG. 6

FIG. 7
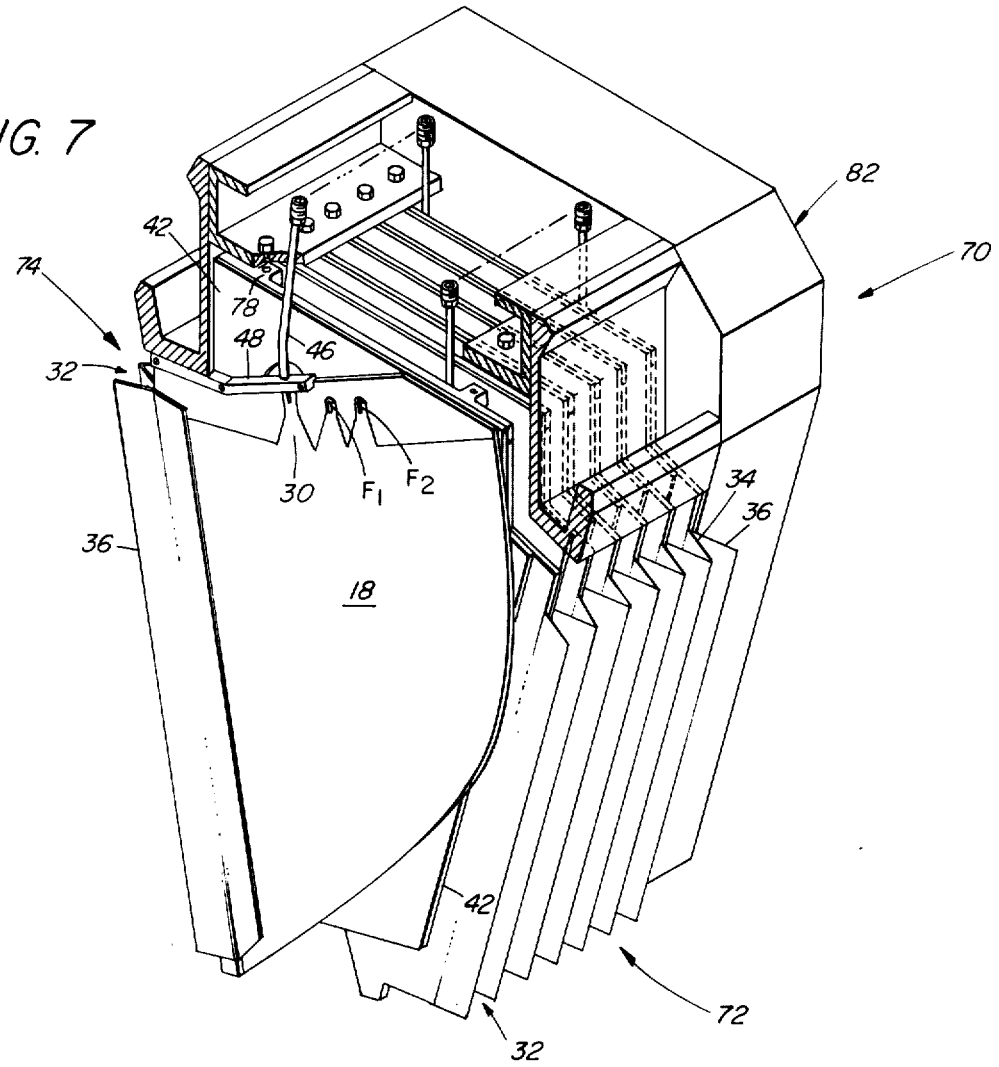
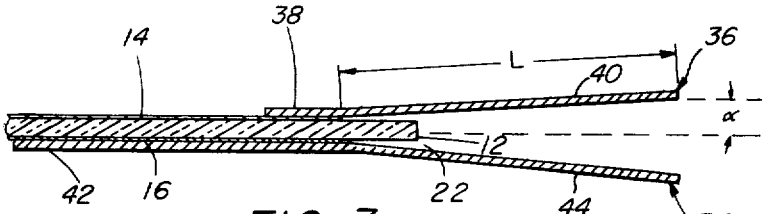
FIG. 3

PARABOLIC HORN ANTENNA WITH MICROSTRIP FEED

BACKGROUND OF THE INVENTION

This invention relates generally to antenna elements and more particularly to small, compact antenna elements suitable for use in high gain array antennas.

As is known in the art, many installations for array antennas impose physical constraints on the size of such antennas. For example, in an aircraft pod installation each one of the antenna elements in the array thereof should have minimum depth and width. One known antenna element characterized by its relatively shallow shape is a so-called "hoghorn" antenna, described by A. B. Pippard in an article entitled "The Hoghorn — An Electromagnetic Horn Radiator of Minimum-Sized Aperture" published in *Journal of the Institute of Electrical Engineers,* Vol. 93, Part IIIA, No. 1, in 1946. The hoghorn antenna as described has one offset waveguide feed structure which introduces radio frequency energy at the focal point of a parabolic wall forming the back plate of a waveguide horn. The feed structures generally used with such a hoghorn antenna include an orthogonal probe coupling or an end-on, double-ridged coaxial-to-waveguide transition section. While the hoghorn is a relatively shallow antenna element, the use of orthogonal probes in the feed structures will not readily enable such antenna element to be used in an array antenna where antenna element spacing in the order of 0.5 λm (where λm is the smallest operating wavelength in the normal operating range of the array) is required to obtain satisfactory reduction in grating lobes. Therefore, in order to provide an intermeshing of antenna elements, adjacent ones being used respectively in port and starboard array antennas, each antenna element must have a thickness less than the order of 0.25 λm. Further, the use of the end-on double-ridged transition section is generally relatively difficult and expensive to construct, especially if the element is to be operated in the 7-17 GHz frequency spectrum.

SUMMARY OF THE INVENTION

With this background of the invention in mind it is therefore an object of this invention to provide an improved compact antenna element suitable for operation in an array antenna.

This and other objects of the invention are attained generally by providing an antenna element comprising a planar dielectric substrate having a pair of conductive sheets formed on opposite sides thereof to form a parallel plate region having a parabolically shaped edge and a radiating edge; a conductive material deposited over the parabolically shaped edge to form a parabolically shaped reflecting wall; a microstrip feed formed on such dielectric substrate, offset from the reflecting wall and adapted to introduce radio frequency energy at the local point of such reflecting wall; and a radiating structure disposed along the radiating edge and flared in shape from the radiating edge to free space. To provide port and starboard array antennas the antenna elements in each one of such array antennas have disposed between adjacent ones thereof the antenna elements of the other one of such array antennas.

BRIEF DESCRIPTION OF THE DRAWINGS

For a more complete understanding of the invention, reference is now made to the following description and to the drawings, in which:

FIG. 1 is an isometric view, exploded and partially broken away, of an antenna element according to the invention;

FIG. 2 is a cross-section of the reflecting wall of the antenna element shown in FIG. 1, such cross-section being taken along the line 2—2 in FIG. 1;

FIG. 3 is a cross-section of the radiating section of the antenna element shown in FIG. 1, such cross-section being taken along the line 3—3 in FIG. 1;

FIG. 5 is an enlarged view of an area encircled in FIG. 1 and labeled 5, such view showing load material used in the antenna element in FIG. 1;

FIG. 6 is a cross-section of the load material taken along the line 6—6 in FIG. 5;

FIG. 7 is an isometric drawing, partially broken away, of an array antenna using a plurality of antenna elements shown in FIG. 1 to form port and starboard array antennas;

DESCRIPTION OF THE PREFERRED EMBODIMENTS

Figure 4:
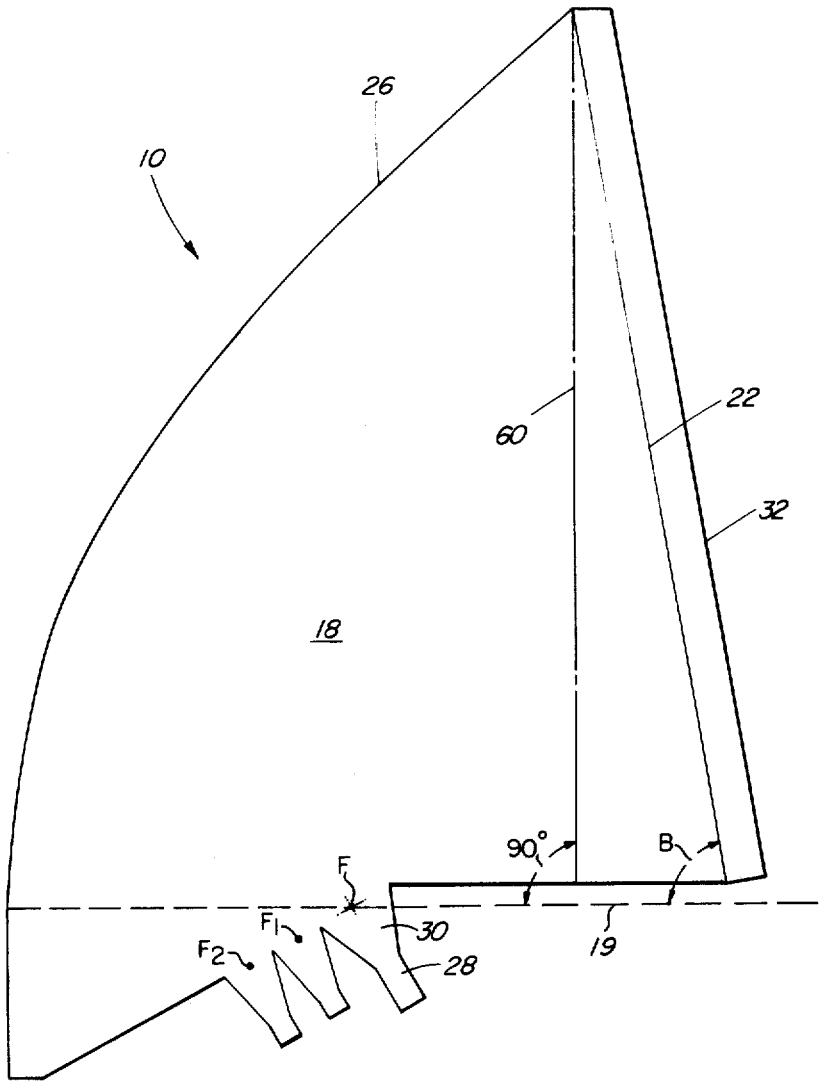
FIG. 4 is a diagrammatic sketch of the antenna element in FIG. 1 useful in understanding the operation of such antenna element.

Referring now to FIG. 1, our antenna element 10, suitable for operation in the frequency range 7-17 GHz, is shown to include a planar dielectric substrate 12 having a pair of conductive sheets 14, 16 (here copper) clad on opposite sides thereof to form a parallel plate region 18. The parallel plate region 18 has a parabolically shaped edge 20 (the axis of such parabola being along the dotted line 19) and a radiating edge 22. A conductive material 24 (FIG. 2), here a conductive epoxy, is deposited over the parabolically shaped edge 20 to form a parabolically shaped reflecting wall 26.

A microstrip feed 28 and matching section 30 are also formed on one side, here the upper side, of the planar dielectric substrate 12, using conventional printed circuit techniques. The conductive sheet 16 formed on the underside of the planar dielectric substrate 12 serves as the ground plane for the microstrip feed 28, matching section 30 and also as one of the two plates of the parallel plate region 18. The microstrip feed 28 is offset from the reflecting wall 26 and is adapted to introduce radio frequency energy at the focal point, F, of such parabolically shaped reflecting wall 26.

A radiating structure 32 is disposed along the radiating edge 22. Such radiating structure 32 is flared in shape from the radiating edge 22 to free space. In particular, such radiating structure 32 includes a pair of conductive members 34, 36, symmetrically disposed about the plane of the planar dielectric substrate 12. The conductive member 36, here gold-plated aluminum, has a base section 38 and a planar flared section 40. The base section 38 overlaps a portion of the conductive sheet 14 adjacent to the radiating edge 22, as shown. Such base section 38 is electrically and mechanically connected to the conductive sheet 14 by any convenient means, here by conductive epoxy. The other conductive member, 34, is formed as a part of a mounting plate 42. Mounting plate 42 is here aluminum and is fastened, here by conductive epoxy, to the conductive sheet 16 as shown in FIG. 3. A portion of the mounting plate 42 which extends beyond the radiating edge 22 is flared to form a planar flared section 44, here gold-plated aluminum. The planar flared sections 40, 44 are symmetrically disposed about the planar substrate 12 in planes which intersect the plane of such planar substrate 12 at an angle $\alpha$, here in the order of 15°. Here each one of such planar flared sections 40, 44 extends a length L in the order of 0.7 inches and the extremes of such flared sections 40, 44 are separated by a width in the order of 0.345 inches. The width of the flared radiating section defines the aperture width of the antenna element 10.

Figure 9:
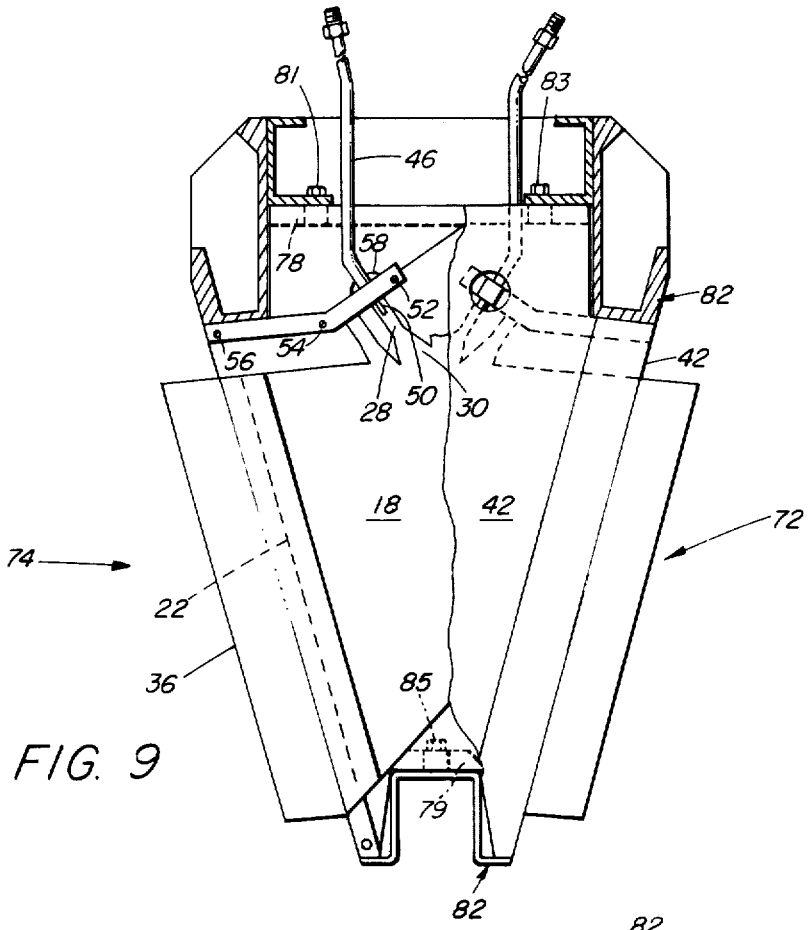
FIG. 9 is an elevation view, partially broken away, of the array antenna shown in FIG. 7.

Referring again to FIG. 1, a coaxial cable 46 has its outer conductor electrically and mechanically connected to a copper support member 48, here by solder (not shown). The center conductor 50 of such coaxial cable 46 passes through, and is insulated from, such support member 48. Support member 48 is electrically and mechanically connected to mounting plate 42 by any conventional means, here by press fitting and epoxying such support member 48 to posts 52, 54, 56 formed on, and in electrical contact with, the mounting plate 42. When assembled the center conductor 50 is fastened, here by solder, to the microstrip feed 28 (as shown in FIG. 9). It is noted that a notch 58 is formed in the dielectric substrate 12, the conductive sheet 16 and the mounting plate 42 to enable the center conductor 50 to connect with the microstrip feed 28 while being electrically insulated from such support member 50 and conductive sheet 16 and to enable the support member 48 to be electrically and mechanically connected to mounting plate 42. In this way the center conductor is electrically connected to the feed 28 (i.e. conductive sheet 14), the outer conductor of coaxial cable 46 is electrically connected to conductive sheet 16 and sheets 14, 16 are electrically insulated from each other.

Referring now also to FIG. 4, the point F is shown disposed at the focal point of the parabolically shaped reflecting wall 26. Further, the radiating edge 22 (or aperture) is shown to intersect the axis 19 of the parabola at an acute angle, B, here 80.1°. In operation, considering the antenna element 10 as a transmitting antenna (realizing that principles of reciprocity apply when such antenna element 10 is used as a receiving antenna) radio frequency energy is introduced into the parallel plate region 18 at the focal point F by the microstrip feed 28. The introduced radio frequency energy radiates from the point F in an expanding cylindrical wave and strikes the parabolically shaped reflecting wall 26, whereupon such wave is reflected as a plane wave which then propagates toward the radiating edge 22 (or aperture). The radio frequency energy radiates directly from the parallel plate region 18 through the flared radiating structure 32 to free space. The radiating edge 22 or aperture is tilted from the planar wavefront of the radiated wave (here represented by the line 60, such line 60 being normal to the axes 19 of the parabola) to minimize the input VSWR of the antenna element 10. In particular, the tilted aperture causes any reflected energy from the radiating edge 22-free space boundary to be brought into a "focus" in the region to the left of the feed point F, as to points $F_1$, $F_2$, shown also in FIG. 1 where such reflected energy is absorbed by load materials 62 shown in FIG. 1, FIG. 5 and FIG. 6. Such load materials 62 are implanted in holes formed in the dielectric substrate 12 and the conductive sheet 14. The load materials 62 are affixed to copper mounting members 64. The mounting members 64 are soldered to the conductive sheet 14 and the load materials 62 are fastened, here by epoxy, into the formed holes. When assembled the load materials 62 are disposed between the conductive sheets 14, 16 to absorb the reflected radio frequency energy described above in connection with FIG. 4.

Figure 8:
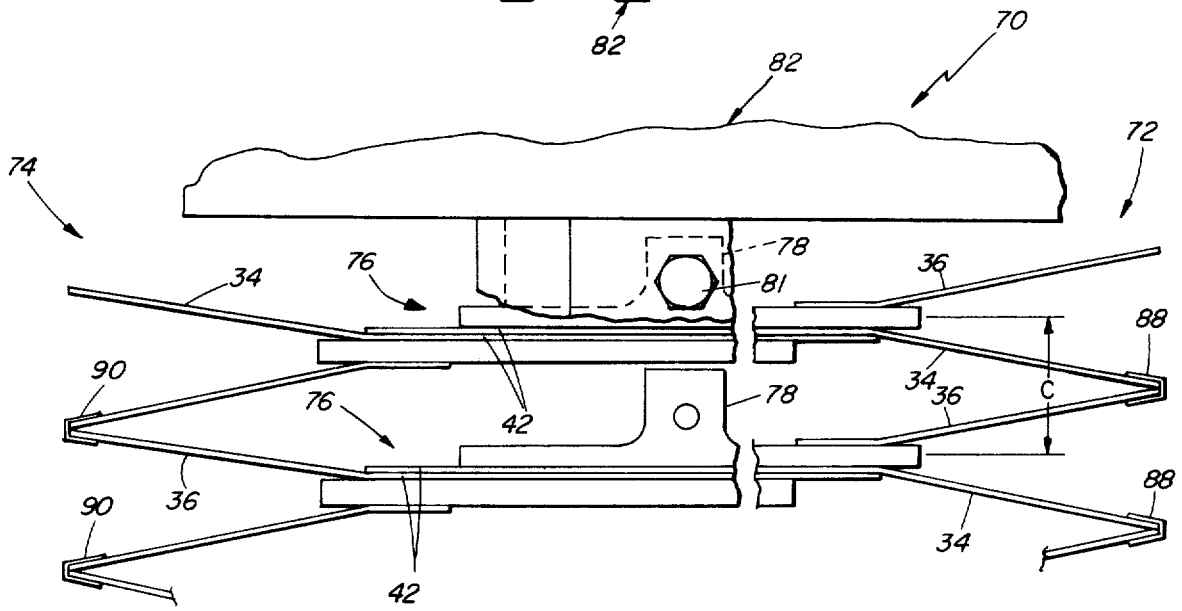
FIG. 8 is a plan view, partially broken away, of the array antenna shown in FIG. 7.

Referring now to FIG. 7, an array antenna 70, suitable for installation in a pod mounted under the fuselage of an aircraft (not shown), is shown to include a port array antenna 72 and a starboard array antenna 74. Referring also to FIG. 8 it should be noted that the array antenna 70 is made up of a number of port and starboard antenna element structures 76. Each one of such port and starboard antenna element structures 76 are made up of back-to-back mounted antenna elements 10 (FIG. 1). In particular, the mounting plates 42 of each one of the back-to-back mounted antenna elements 10 are fastened together, here by a conductive epoxy, so that each one of the port and starboard antenna element structures 76 are integral units. Mounting members 78, 79 (FIG. 1) are fastened to the mounting plates 42, here by rivets (not shown). The mounting members 78, 79 enable each integral port and starboard antenna element structure 76 to be fastened, here by screws 81, 83, 85 to a frame 82 (as shown in FIGS. 7, 8 and 9). The tips of the radiating structures 32 of adjacent antenna elements in the port array antenna 72 are fastened together, here by copper conductive tape 88, as shown in FIG. 8. Likewise, the tips of the radiating structures 32 of adjacent antenna elements in the starboard array antenna 74 are fastened together, here by copper conductive tape 90, as shown in FIG. 8. The fastening of the tips, as described, provides the effect of forming continuous ground planes for the port and starboard array antennas 72, 74. It is noted that the antenna elements in either the port or starboard array antennas are separated a distance C (FIG. 8) here in the order of 0.345 inches (less than $\lambda m/2$ where $\lambda m$ is the minimum wavelength of the normal operating band of the array antenna 70). The coaxial connectors of the port array antenna 72 (or the starboard array antenna 74) are connected to any suitable transmitter/receiver (not shown). For example, such may be connected to a plurality of such transmitter/receivers through a parallel plate radio frequency lens to provide a multibeam array antenna as described in U.S. Pat. No. 3,761,936, Multi-Beam Array Antenna, Donald H. Archer, Robert J. Prickett and Curtis P. Hartwig, inventors, issued Sept. 25, 1973 and assigned to the same assignee as the present invention. Alternatively, such coaxial connector may be coupled to a transmitter/receiver through a corporate feed having variable phase shifters to provide a phased array antenna.

Having described a preferred embodiment of the invention, it is evident that other embodiments incorporating its concepts may be used. For example, the antenna element may be scaled for operation over other frequency bands. Further, other mounting arrangements than those described may be used. It is felt, therefore, that this invention should not be restricted to the disclosed embodiment but rather should be limited only by the spirit and scope of the appended claims.

What is claimed is:

1. An antenna element comprising:

a planar dielectric substrate having a pair of conductive sheets formed on opposite sides thereof to form a parallel plate region having a parabolically shaped edge and a radiating edge;

a conductive material deposited over the parabolically shaped edge to form a parabolically shaped reflecting wall;

a microstrip feed formed on such dielectric substrate, such feed being offset from the reflecting wall and disposed adjacent the focal point of the reflecting wall; and a radiating structure disposed along the radiating edge and flared in shape from the radiating edge outwardly to free space.

2. The antenna element recited in claim 1 wherein the radiating structure includes a second pair of conductive sheets, one edge of each one thereof being electrically connected to a corresponding one of the conductive sheets formed on the dielectric substrate.

3. The antenna element recited in claim 2 wherein the radiating edge is disposed along a line which is at an acute angle with respect to the axis of the parabolically shaped edge.

4. The antenna element recited in claim 3 including a load material disposed between the conductive sheets formed on the dielectric substrate, such load material being disposed at a point displaced from the focal point of the parabolic reflecting wall

5. An antenna including port and starboard antenna arrays, comprising a plurality of antenna element structures, each one of such structures comprising:

a pair of dielectric substrates, each one thereof having a pair of conductive sheets formed on opposite sides thereof to form a pair of parallel plate regions, each one of such pair of parallel plate regions having a radiating edge;

microstrip feeds formed on each one of the dielectric substrates, one of the pair of conductive sheets formed on one of the dielectric substrates providing a ground plane for the feed formed thereon and one of the pair of conductive sheets formed on the other one of the dielectric substrates providing a ground plane for the feed formed thereon;

a pair of radiating structures disposed along corresponding ones of the radiating edges, such radiating structures being flared in shape from the radiating edge outwardly to free space, one of such radiating structures forming a portion of the port antenna array and the other one of such radiating structures forming a portion of the starboard antenna array wherein adjacent radiating structures forming the port array antenna are separated less than $\lambda m/2$ where $\lambda m/2$ is the smallest operating wavelength in the normal operating range of the antenna; and Wherein each one of the parallel plate regions has a parabolically shaped edge, and including additionally a conducting material deposited over the parabolically shaped edge to form a parabolically shaped reflecting wall.

6. The antenna recited in claim 5 wherein the microstrip feeds are disposed at the focal points of the reflecting walls.

7. The antenna recited in claim 6 wherein the radiating edges are disposed along lines which are at acute angles with respect to the axes of the parabolically shaped edges.

8. The antenna recited in claim 7 including load materials disposed between the conductive sheets on the dielectric substrates, such load materials being disposed at points displaced from the focal points of the parabolic reflecting walls.

* * * * *